US005761872A

United States Patent [19]

Sanford et al.

[11] Patent Number: 5,761,872

[45] Date of Patent: Jun. 9, 1998

[54] VARIABLE LENGTH TRUSS AND METHOD FOR PRODUCING THE SAME

[76] Inventors: Emmett Barry Sanford, Highway 18 West; Emmett Cecil Sanford, Jr., 1st St. NW., P.O. Box 473, both of Vernon, Ala. 35592

[21] Appl. No.: 914,228

[22] Filed: Aug. 19, 1997

Related U.S. Application Data

[63] Continuation of Ser. No. 472,769, Jun. 7, 1995, abandoned, which is a continuation of Ser. No. 52,209, Apr. 21, 1993.

[51] Int. Cl.[6] ..... E04C 3/16

[52] U.S. Cl. ..... 52/694; 52/729.4; 52/730.7; 52/731.1

[58] Field of Search ..... 52/690, 692, 693, 52/694, 695, 729.1, 729.2, 729.4, 730.1, 730.7, 731.1, 737.1, 737.3

[56] References Cited

U.S. PATENT DOCUMENTS

| | | | |
|---|---|---|---|
| 1,565,879 | 4/1925 | White . | |
| 2,668,606 | 6/1954 | King . | |
| 3,490,188 | 1/1970 | Troutner | 52/729.4 |
| 3,651,612 | 3/1972 | Schmitt | 52/693 |
| 3,769,771 | 11/1973 | Shannon et al. . | |
| 3,991,535 | 11/1976 | Keller et al. . | |
| 4,001,999 | 1/1977 | Chandler . | |
| 4,114,328 | 9/1978 | Lawrence . | |
| 4,336,678 | 6/1982 | Peters | 52/729.4 |
| 4,435,929 | 3/1984 | Bussell | 52/690 |
| 4,463,887 | 8/1984 | Bloys . | |
| 4,501,102 | 2/1985 | Knowles | 52/690 |
| 4,525,974 | 7/1985 | Steidle-Sailer et al. | 52/729.4 |
| 4,548,014 | 10/1985 | Knowles . | |
| 4,637,194 | 1/1987 | Knowles | 52/690 |
| 4,677,806 | 7/1987 | Tuomi | 52/690 |
| 4,699,547 | 10/1987 | Seemiller . | |
| 4,745,724 | 5/1988 | Reetz . | |
| 4,787,183 | 11/1988 | Johnston . | |
| 4,852,322 | 8/1989 | McDermid | 52/690 |
| 4,862,662 | 9/1989 | Eberle et al. | 52/729.4 |
| 4,926,593 | 5/1990 | Johnston . | |
| 4,957,186 | 9/1990 | Reetz . | |
| 5,111,861 | 5/1992 | Gore et al. . | |
| 5,509,338 | 4/1996 | Ekker . | |

FOREIGN PATENT DOCUMENTS

| | | | |
|---|---|---|---|
| 2008043 | 7/1991 | Canada . | |
| 903373 | 2/1954 | Germany | 52/693 |
| 3423 751 | 1/1986 | Germany . | |
| 3423751 | 1/1986 | Germany | 52/729.4 |
| 896984 | 5/1962 | United Kingdom | 52/730.7 |
| 1356941 | 6/1974 | United Kingdom | 52/729.4 |

OTHER PUBLICATIONS

*Builder*, "The Magazine of the National Association of Home Builders", Sep. 1993, p. 155.

*Primary Examiner*—Michael Safavi
*Attorney, Agent, or Firm*—Bell, Boyd & Lloyd

[57] ABSTRACT

An open web beam composed of wooden top chord and an open web central structure terminated on at least one end by wooden members in the form of a closed web wherein the closed web is reinforced by insertion of a portion of the closed web into a strut and the two chords which have been slotted or grooved for this purpose. The closed be being oriented strand board using structural adhesive without interfering mechanical fasteners in the web.

41 Claims, 6 Drawing Sheets

VARIABLE LENGTH TRUSS AND METHOD FOR PRODUCING THE SAME

This is a continuation of application Ser. No. 08/472,769, filed on Jun. 7, 1995, now abandoned; which is a continuation of Ser. No. 08/052,209 filed Apr. 21, 1993, abandoned.

BACKGROUND OF THE INVENTION

This invention relates broadly to the art of construction trusses and joists.

More particularly the invention relates to open web truss designs for application to ceiling, roof and floor joists.

More particularly the invention relates to a process and product for use as trimmable trusses or joist which combine the benefits of open web truss construction with closed web construction providing variable length while conserving the integrity of the factory test requirements and component strength with variable spans.

Truss designs in the prior art envision three broad design types.

Two by ten or two by twelve joists made of solid wood are very common. The major problems associated with these are that they require old growth timber to provide wide enough lumber. In addition, when oriented edgewise, they provide an inferior nailing surface compared with that provided by two by fours oriented flatwise. This is particularly important when adding subfloors and ceilings to the joists since only an approximate location of the supporting member can be found. In addition, span lengths are greatly diminished by the load bearing properties of these timbers.

To address the cost, assembly and load bearing problems, manufactured trusses utilizing two by four chords with an interior webbing have been used. Two basic types encompass the two remaining truss design types.

Open web trusses of several designs are known in the art. An example of an open web truss is White, U.S. Pat. No. 1,565,879. White discloses a truss having a web of the depth of the truss which is shaped at either end to fit within a recess in the upper and lower chords which are provided with channels for receiving the shaped ends. The shaped ends are part of a web which has been thickened and provided with a flanged seat for placement of the truss during construction. The web and the chords have had their structural integrity and stress bearing features affected by the process. The present invention maintains structural parameters.

Further, If the seat is removed, as by trimming, the effectiveness and purpose of this structure is negated.

White also provides for a complex and built up leading and trailing edge for purposes of maintaining strength and hanging the truss. The webs making up the I-beam ends are mounted by way of channels in the chords which hold the diagonal struts by compressing the sides of these channels. Fillets are pressed into the wood in order to anchor this engagement.

These trusses are particularly described to define a non-trimmable truss. The net effect of trimming a truss of this form would be to affect the structural integrity built into the truss by virtue of the fillets and cause potential splitting at the channels holding the struts.

A similar design is disclosed in the pressed in dovetail type joint disclosed in Keller, et al U.S. Pat. No. 3,991,535. Keller shows the use of grooved members between parallel tongues (corresponding to the chords of White) for receiving an I beam of a truss (corresponding to the webs of White).

Keller discloses the difficulty of using dovetail joints and addresses a method of improving this design. Keller discloses the use of glue in order to strengthen the glued dovetail of the joints.

The invention is directed to a joint which is self clamping in order to avoid or decrease the need for structural improvements.

These are shown as incremental portions of a partially open web truss in Keller. Keller also fails to utilize two by four open webbing, also generally referred to as cross webbing which adds strength and reduces costs of construction as well as enhancing the crush strength of the interior web and providing greater opportunity to run conduit and pipes through the component.

King, U.S. Pat. No. 2,668,606 shows an I-beam utilized in the end piece of prefabricated steel beams.

Seegmiller, U.S. Pat. No. 4,699,547 shows a variable length truss and the problems of maintaining structural integrity of the members is indicated.

In all of the patents utilizing wooden members, the shape and structure and therefore the integrity of the web members has been altered since the structure can be kept within limits by maintaining the length of the truss.

One of the problems recognized by the present example is that I-beam construction of this type results in an inability to make on site corrections to the length of trusses. This problem can result in the need to re-manufacture the entire truss.

To address this problem in the past, construction techniques used have included a closed web of the type shown in Keller extending the entire length of the structure. As with Keller, this creates a number of problems. First, at least a portion of the interior webbing is closed and cannot be used for running lines or conduit without bracing, known generally in the art as web stiffeners, being added and calculations being necessary for determining the stability and crush strength of the altered bracing. In order to have a safety. factor built in solid web construction as designed for cutting into variable lengths with a varying location for the load has required that the entire beam be made of a solid web.

Note that Keller could not be cut without raising a number of questions as to crush strength and load bearing location. At a very minimum web stiffeners would need to be used, again requiring engineering on the site.

The closed truss is the most common variable length truss. Closed truss design suffers from several construction problems. First, the design requires a great deal more material, having a closed volume. Second the design has difficulty with respect to working within the area defined by the interior of the truss since it is solid and must be cut for additional work. This provides for two problems. First, the strength of the truss may be affected by the work. Second, a great deal of time and equipment may be necessary in order to manufacture a space in which to work. Other related problems may exist as a result of these general problems including the need to use "web stiffeners" and engineer where holes may be made and where web stiffeners are to be placed.

In addition to other reasons, the weight of these types of trusses make them hard to ship and hard to work with.

The major problems with the solid web, other than the inability to use it easily in the field without engineering to pass conduit, is the cost. Solid webbing of the type needed to distribute stress is an expensive value added wood manufactured product comprises of glue and chips compressed together.

The prior art has failed to date to provide an open web truss which has a variable length and this failing has required that all cross web construction be made to order requiring huge risks of error, high turn around times and inflexibility for the end user. The prior art also fails to show a trimmable truss which does not require on site modification to maintain crush strength.

The prior art also fails to show a method for constructing trusses with web strengtheners in place at a low cost.

It is therefore the primary object of the invention to provide a new truss or joist incorporating the benefits of open webbing with variable length structural components required in the industry.

It is a further object to provide a structural components which can replace expensive and environmentally unsound two by ten or two by twelve floor and ceiling joists.

It is therefore an object of this invention to produce a truss which can be of variable length without affecting the structural integrity of the truss I-beam section and maintaining a particular crush strength. It is a further object to provide a varying location for the load bearing surface.

It is a further object of the invention to provide a truss which has a variable load point on either end of the truss.

It is further object of the invention to produce trusses of variable lengths having trimmable ends without requiring on site engineering.

It is a further object of this invention to teach a method of constructing trusses of variable length.

It is a further object of the invention to teach a method of simplifying cross web truss construction.

It is a further object of this invention to disclose a system for construction utilizing variable length trusses.

These and other objects and advantages of the invention will become better understood hereinafter from a consideration of the specification, with reference to the accompanying drawings forming a part thereof and in which like numerals correspond to parts throughout the several views of the invention.

In accordance with the present invention, there is provided a structural component comprising (a) a top chord member means for receiving load and trimming defining at least one weight bearing end; (b) a bottom chord member for receiving load and trimming defining a left and right end; (c) an open web means for connecting the top and bottom chords; and (d) at least one load bearing solid web located at the at least one weight bearing end of the chord members and occupying the space within the load bearing surface of the chords.

Also in accordance with the present invention, there is provided a method of constructing floor and ceiling joists utilizing open web construction without having exact span specifications comprising preparation of a series of trimmable open web members of variable length having closed web ends for trimming; determining by mental operation the number of joists of each size are needed utilizing the desired spans; and trimming the joists of the appropriate size on the site to fit within specific parameters of the site as constructed.

GENERAL DISCUSSION OF THE INVENTION

1. Technology

All products envisioned under this patent would be designed in accordance with the National Design Specifications (1991) and the recommendations of the Truss Plate Institute (PCT-80). Thus, compliance to local building codes would be assured.

Modern, high strength, structural adhesives and special equipment make possible the fabrication of end sections without the use of any mechanical fasteners so that lengths may be modified in the field.

¾" OSB (oriented strand board) is used to maintain strength away from the web stiffeners used.

For architects and volume purchasers, technical assistance from industry experts and professional engineers would be available where necessary for the method of use.

2. The Advantages of the system would include

A. In-field customization for a closer hand fit.

B. Higher strength allows longer spans with greater on-center spacing-resulting in a net savings in total board-feet of wood fiber (about 12% less than typical 2×12 construction) and less deflection.

C. Open web construction allows for easy passage of duct work, conduit and pipe throughout the length of the TrimJoist-no more hole cutting or notching with consequent problems.

D. The 4×2 chord orientation provides a greater nailing surface for decking, thereby reducing squeaks and giving a more rigid floor system. Minimum chord grade is #1 SP in the preferred embodiment.

E. Environmentally Friendly-all wood fiber can be supplied from plantation-grown trees. Unlike 2×12s, no "old growth" forest lumber is required when framing with TrimJoist.

Examples of the structural aspect of inventions built within the parameters of the disclosure set forth herein follow in the following tables:

SPAN/DEFLECTION TABLE

| Stock Length | 4' | 6' | 8' | 10' | 12' | 14' | 16' | 18' |
|---|---|---|---|---|---|---|---|---|
| Span Minimum | 1'-9" | 3'-9" | 5'-9" | 7'-9" | 9'-9" | 11'-9" | 13'-9" | 15'-9" |
| Range Maximum | 3'-9" | 5'-9" | 7'-9" | 9'-9" | 11'-9" | 13'-9" | 15'-9" | 10'-9" |
| Max Live Load Deflection | .01" | .01" | .03" | .06" | .11" | .20" | .34" | .52" |
| Max Total Load Deflection | .02" | .02" | .04" | .08" | .17" | .30" | .50" | .77" |
| Maximum L/D | 4.3 | 6.4 | 8.5 | 10.7 | 12.8 | 14.9 | 17.1 | 19.2 |

UNIFORMLY DISTRIBUTED PSF LOADING (0% Stress Increase)

| | | | | | |
|---|---|---|---|---|---|
| Top Chord Live: | 40.0 | 50.0 | 60.0 | 70.0 | 80.0 |
| Top Chord Dead: | 10.0 | 12.5 | 15.0 | 17.5 | 20.0 |
| Bottom Chord Live: | 0.0 | 0.0 | 0.0 | 0.0 | 0.0 |
| Bottom Chord Dead: | 10.0 | 12.5 | 15.0 | 17.5 | 20.0 |
| TOTAL LOAD: | 60.0 | 75.0 | 90.0 | 105.0 | 120.0 |
| SPACING: | 24.0" | 19.2" | 16.0" | 13.7" | 12.0" |

Strongback Note (Web strengtheners): By way of example, the invention envisions in certain cases web fasteners when utilizing two by four construction. For example, a 2×4 #2SP (or equal) strongback is required when span exceeds 9'-9". Install perpendicular to one vertical member at either side of center chase. Attach using 2-10 d nails, staggered through strongback into vertical member. Strongback is to run continuously and be properly nailed to each member. If splicing is necessary, use 4' long scab centered over each splice and attach using 10 d nails at 4" c/c spacing.

Anchorage Note: Web strengtheners would be attached with device(s) deemed suitable for use in conjunction with provided support (see architect or building designer).

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

1.

2.

3.

4.

5.

6.

DETAILED DISCUSSION OF THE PREFERRED EMBODIMENT(S)

Figure 1:
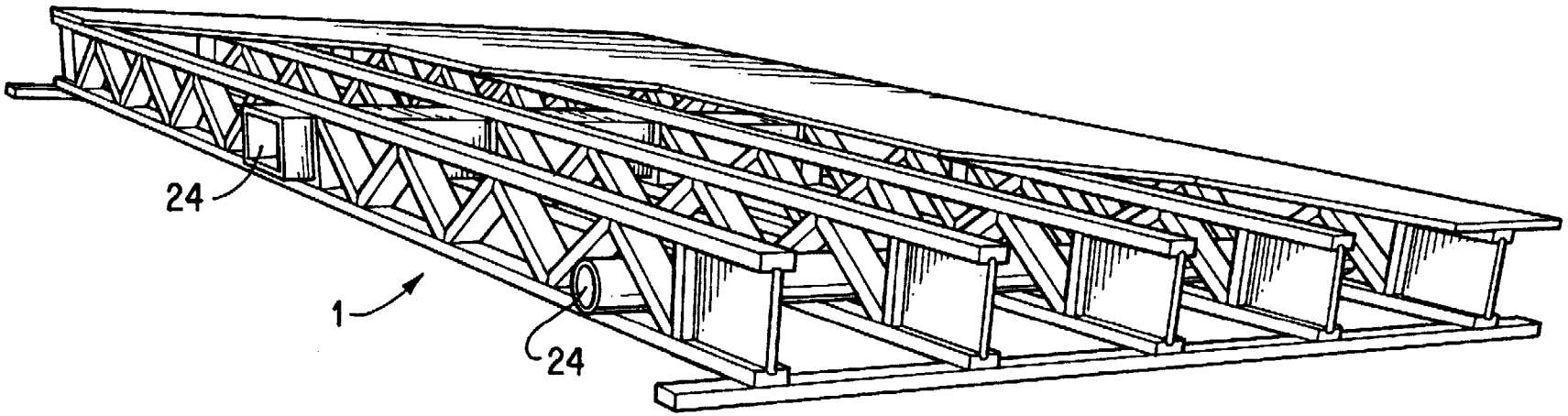
FIG. 1 is a perspective view of the preferred embodiment.
Figure 2:
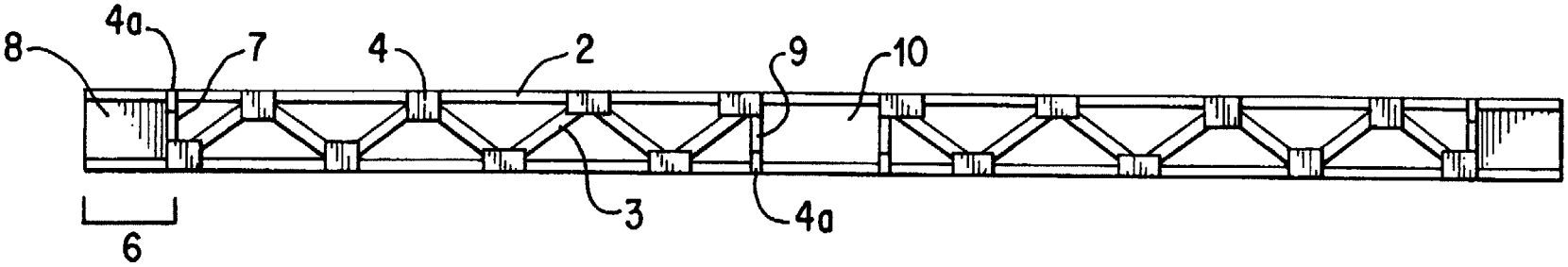
FIG. 2 is a cross sectional view of FIG. 1 through the A—A axis.

As can best be seen by reference to FIG. 1, the structural component system 1 is constructed of a series of individual truss members as shown as 2 in FIG. 2 and the ends of the structural component are constructed of wooden flanges separated by a vertical wooden solid web material.

As can best be seen by FIG. 2, each of the cross member 3 is constructed generally using cross beams 3 and chords 5. An end unit 6 comprised of a strut 7 and a closed or solid web 8 complete the interior portions. The chords are bound to the struts 7 and the cross members 3 utilizing metal fasteners 4. These fastener 4 are known in the art and appear as a metal sheet out of which sharp points or nails have been punched. Typically, these fasteners 4 need to be in place or both sides of the cross beams 3, struts 7 and chords 11 and 12. A smaller fastener 4a is used in order to secure the top or bottom of vertical beams 9 defining duct opening 10 and the top of struts 7.

The strut may be slanted as required by roof type truss members.

Figure 3:
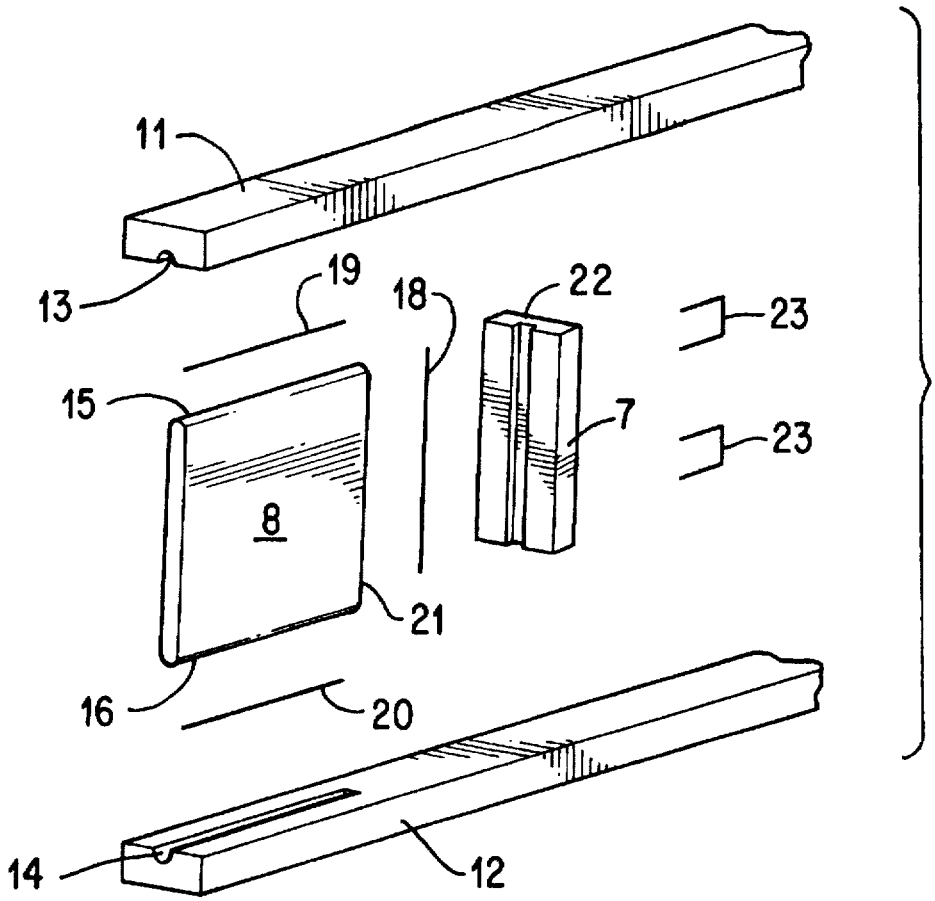
FIG. 3 is a break down of a detailed section of the trimmable I-beam used in FIG. 1.
Figure 4:
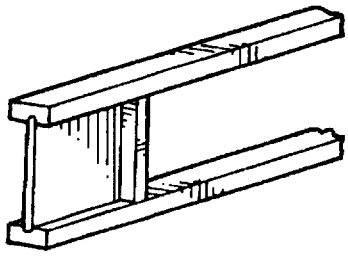
FIG. 4 shows the I-beam of FIG. 3 as assembled.

As can best be seen by reference to FIG. 3 and 4 a key element of the invention is the end unit 6. End unit 6 is comprised on the weight bearing end of the top chord 11 and bottom chord 12. The ends of chords 11 and 12 have been fitted to have a top groove 13 and a bottom groove 14. These grooves 13 and 14 correspond to the top plug 15 and bottom plug 16 defined by the top and bottom rounded ends of the solid web 8. The grooves are typically ½" in a 2×4 chord to maintain thickness of the 2×4 during curing and when weight is supplied during use.

The grooves 13 and 14 and corresponding plugs 15 and 16 are rounded in order to provide a smooth stress profile when pressed together tightly, as by the construction technique described below for making the truss or by loads pressing on the truss in a construction setting. square or non-rounded openings as are present in the prior art at these locations result in stress singularities which can cause cracking. By providing semi-circular grooves, the stresses present are evenly distributed without affecting the strength of the lumber. Typically, in a two by four, these grooves would be approximately ⅓ of the depth of the two by four. This shaping also allows for a better method of manufacture by allowing easier insertion with the plugs 15216.

Closed web 8 is longer than strut 7 by the combined depth of grooves 13 and 14. Strut 7 has a height defined by the spacing desired between the top chord 11 and bottom chord 12.

Glue line 18 serves to fix the side 21 of closed web 8 into a slot 22 in the strut 7. In addition, in order to maintain the location and pressure on the glue line 18 during curing, metal staples or pins 23 are used to further secure the strut 7 to the side 21 of closed web 8.

Top glue line 19 and bottom glue line 20 are used to secure top plug 15 and bottom plug 16 into top groove 13 and bottom groove 14 respectively. The metal pins 23 cannot extend into the closed web 8 a greater distance than that encompassed by the sides of the slot 22. Slot 22 and the side 21 or web 8 are squared to facilitate the introduction of the pins 23. The slot 22 and side 21 may be squared since they do not bear significant and controlling stresses.

The length of the grooves 13 and 14 and corresponding length of the top 15 and bottom 16 of closed web 8 may be different without departing from the inventive concept embodied herein overall depth from top to bottom amy also vary-length of side 21 on FIG. 3 can vary as well.

The combination of the chords and strut and closed web as described above may form a trimmable I-beam without sacrificing strength or deflection tolerances utilizing normal two by four construction for the chords and strut and having the closed web comprised of oriented strand board having a top grooved face corresponding in shape to the top groove and a bottom grooved face corresponding to the shape of the bottom groove so as to form a fit is joined by structural adhesive by joining the top groove and bottom groove to the top and bottom grooved faces respectively.

The real benefit of having the trimmable end in combination with the open web construction can be seen by reference to FIG. 1. As seen by FIG. 1, the running of conduit 24 is simplified by having the open web design. Because the end of the structural components 2 is capable of modification, the structural components 2 may be mass produced instead of job ordered. Close tolerances can be maintained during factory assembly. Unlike a solid web as is known in the art, no special cuts need to be made in the interior, the components are strengthened by struts resulting in an open web and less material needs to be used.

This results in a substantial savings in turn around time, cost savings, material quantity and weight savings, and labor savings since the engineering of specific trusses is taken care of prior to delivery. Other aspects of engineering required by cutting openings for conduit are also eliminated.

The width and height of the solid web 8 for the invention is defined by the requirements of chord load in the center of the open web and the fact that a minimum amount of length solid webbing 8 is desired to keep the web stiffener 7 effective and to control costs. As described below 2' of solid webbing 8 allows for mass production usage.

In addition, by having these variable length trusses in several sizes, they may be stocked like two by twelve truss members allowing for easier availability than with prior art products.

Finally, as described in more detail below, the construction of this particular type of truss provides for an improved method of construction of open web structural components.

The method for using the members described herein envisions a line assembly of the components.

First, the size of the unit must be determined and engineered using known specifications for open web cross web construction reduced for the length of trimmable closed webbing on at least one side of the truss. In the preferred embodiment, the closed webbing appears on either side to allow easy use.

In order to allow that only a single strut 7 is necessary per side, thereby avoiding the need for on site web stiffening, typically only one foot on either side of the truss 2 utilizes closed webbing 8. Closed or solid web 8 allows for a variable bearing point or load bearing surface as apposed t a fixed bearing part or surface as in other open web construction. It is obvious given the disclosure that web stiffening may be provided at other locations to allow for longer runs of closed webbing 8 as by having either side of the strut 7 grooved to receive the front of one section of closed webbing and the back of another section of closed webbing.

Figure 6:
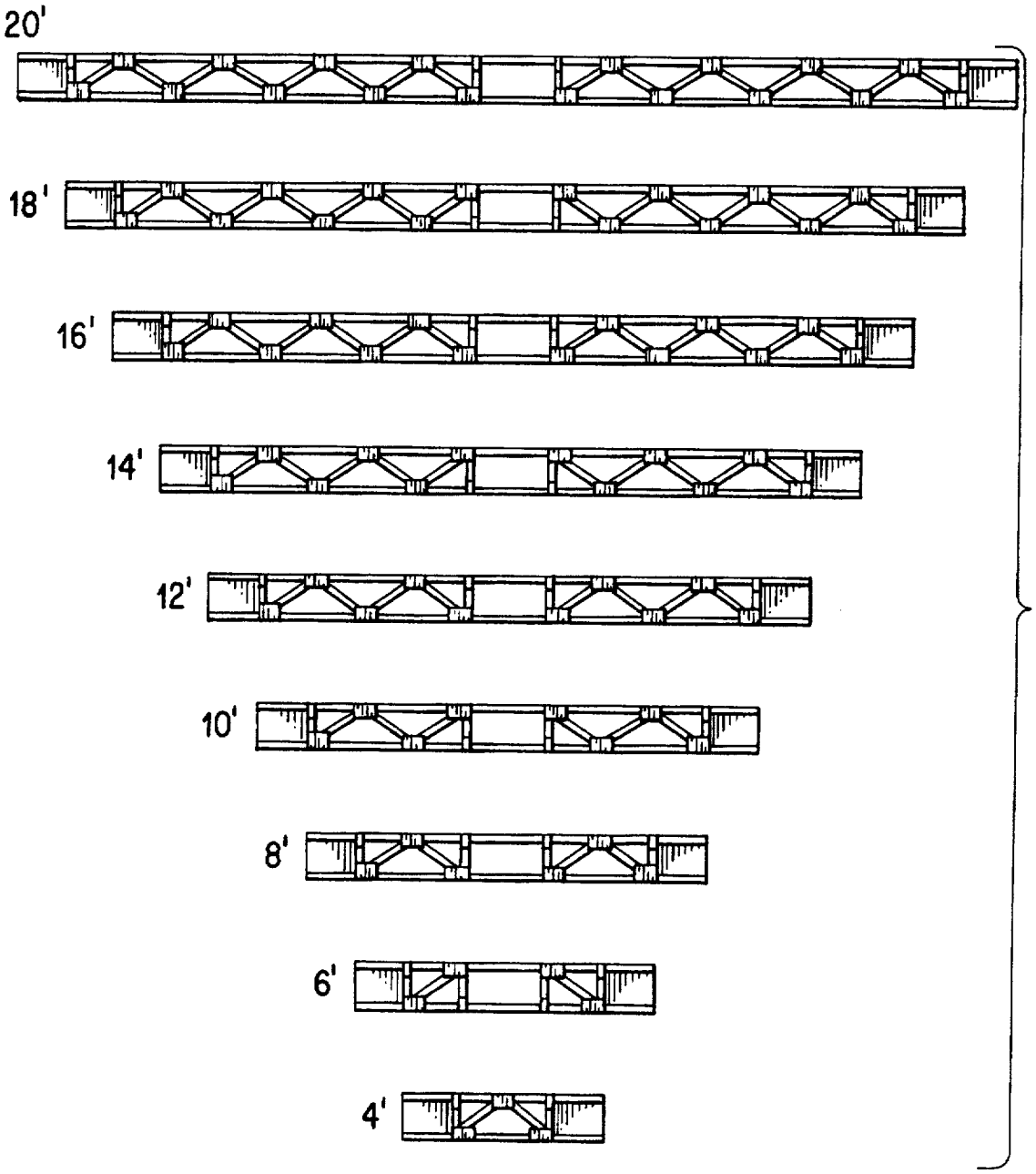
FIG. 6 shows the use of succeedingly two foot increases in beam size for purposes of use of the product in construction.

The sections determined necessary for typical use as shown in FIG. 6 would include sections of 20 feet, 18 feet, 16 feet, 14 feet, 12 feet, 10 feet, 8 feet, 6 feet and 4 feet. Every 4 foot section typically would have two cross members 3. Every 6 foot section would have two cross beams 3 and two vertical beams 9 to define a square duct opening 10. For all the longer trusses, for every two feet added, an additional two cross 3 would need to be added. The beauty of this system is that, since all of the truss sections are trimmable by two feet, every imaginable size up to the longest or maximum span of 24 feet (the maximum being arbitrarily determined), is included.

Because this provides for a series of sections, which may be assembled by size needed, it is possible to extend the size without changing the basic specifications. Because all sizes are covered, a warehouse may stock inventory the product as an alternative to more expensive solid web units or two by twelve or ten units.

A method of constructing floor and ceiling joists utilizing open web construction without having exact span specifications is disclosed by:

1. preparation of a series of trimable open web member of variable length having closed web ends for trimming;
2. Determining by mental operation the number of joists of each size are needed utilizing the desired spans;
3. Trimming the joists of the appropriate size on the site to fit within specific parameters of the site as constructed.

Figure 5:
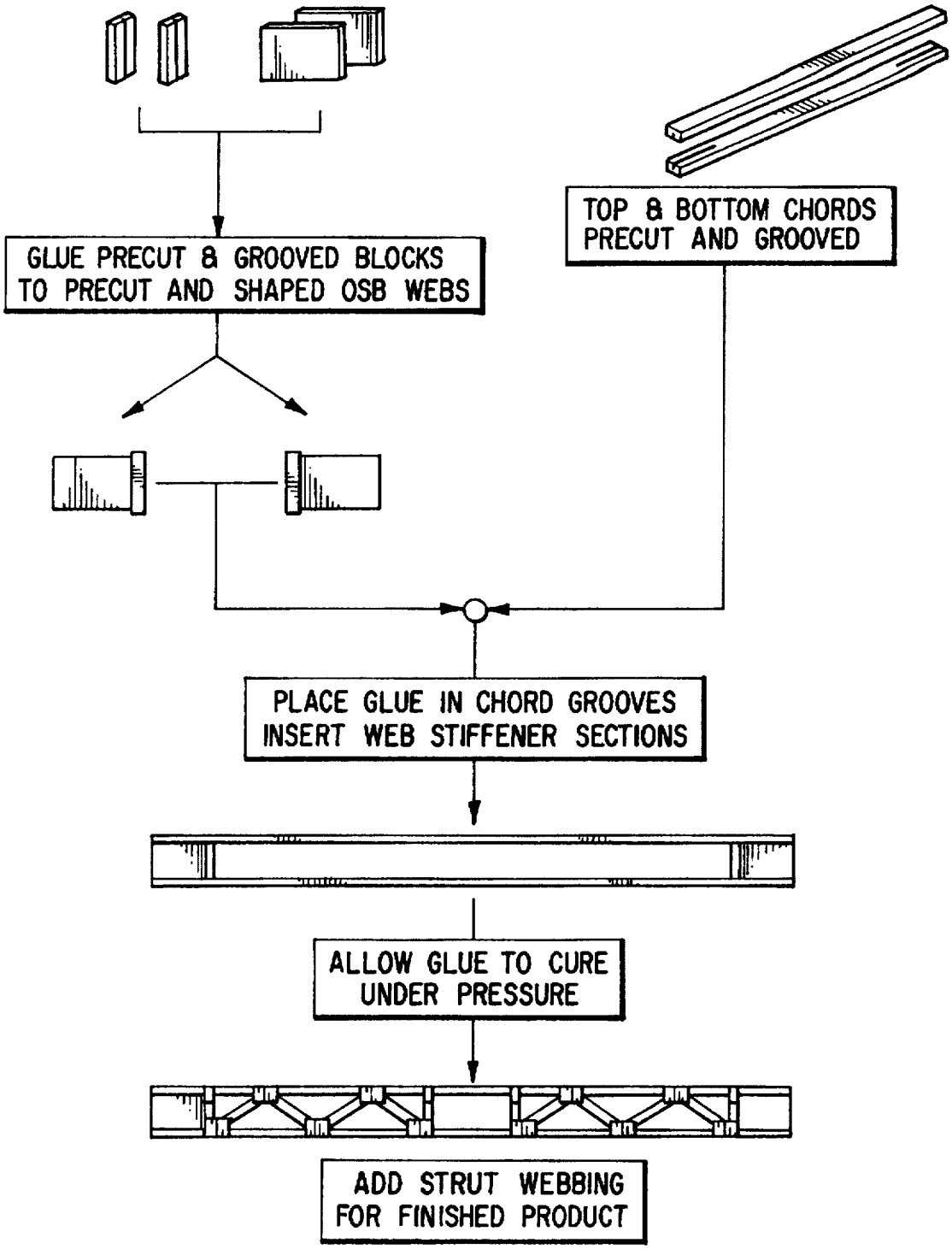
FIG. 5 shows the process described herein for making Truss sections using the technology disclosed in the specification.
Figure 5A:
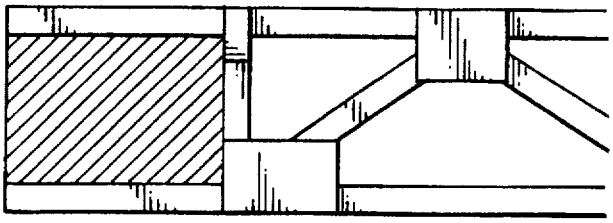
FIG. 5*a* is a typical square cut detail.
Figure 5B:
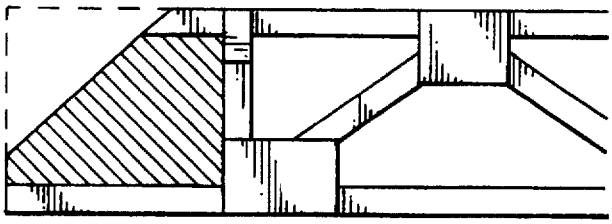
FIG. 5*b* is a typical rafter cut detail.

The method envisioned for producing a superior and simplified cross web truss utilized in this specification can be set out as several steps as illustrated in FIG. 5.

The first step in the production of units of variable sizes having an open web design with a trimmable end comprises the step of:

(a) determining the separation distance of the cords;

(b) next would be cutting the two struts in the desired determined length to maintain the desired space between the chord members;

(c) cutting square cuts within the struts to receive the solid web;

(d) cutting a solid web so as to have a side to fit within the square cuts and extend to form a plug on either side of the strut;

(e) cutting or molding the solid web so as to form plugs having curved ends on either side of the struts;

(f) placing glue within the square cut;

(g) placing the web and struts within a jig to align the square cut on the side of the web with the square cut on the strut;

(h) compressing the side of the web within the square cut;

(i) fixing the web to the strut with two staples to maintain the position and tension on the glue during the setting so that there is a mounting of the length of solid webbing to the strut and perpendicular to strut at a set location on the strut and running perpendicular to the intersection of the strut with the chord member (and extending beyond the point of intersection of the strut with the chord member so as to allow the chord member to be cut to receive the solid webbing;

(j) cutting grooves within the top chord to receive the portion of the solid webbing extending beyond the point of intersection of the strut and cutting groove within the bottom chord to receive the portion of the solid webbing extending beyond the point of intersection of the strut corresponding and opposite to the location of the cut in the top chord so that when the top plug and bottom plug are within the corresponding the grooves, the top chord and the bottom chord are aligned.

(k) placing the bottom chord on a rack;

(l) securing the bottom plug to the bottom groove on at least one end of the bottom chord utilizing a glue line in the top groove;

(m) securing the top chord to the top groove so as to align the chords utilizing a glue line in the bottom groove; securing the top chord and top plug and bottom chord and bottom plug on either end of the chords. The use of the separator described in FIG. 3 and 4 and steps a–i is particularly important as the separation defined by the separator is key to the truss strength as to central chord stress as opposed to bearing stress on the closed web on either end.

(n) putting a top rack on top of the bottom rack;

(o) compressing the top rack onto the bottom rack as by compressing one rack to the other;

(p) inserting sections of cross webbing within the space formed by the at least one strut between the chords.

Because of the many and varying and different embodiments which may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

We claim:

1. A variable length truss for use in a structure as a ceiling, a roof or a floor joist comprising:

an upper chord having a first longitudinal groove in a bottom surface at a first end of said truss;

a lower chord spaced from and parallel to said upper chord, said over chord having a second longitudinal groove in a top surface thereof beneath said first groove;

a first vertical strut at said first end of said truss between said upper chord and said lower chord and inboard of said first groove and said second groove; said first strut having a vertical groove in an outboard side thereof;

a second vertical strut at a second end of said truss between said upper chord and said lower chord;

an open web section including a plurality of members, said open web section being inboard of said first and second struts and between said upper chord and said lower chord;

a first solid web member having a top and bottom thereof seated in said first groove and said second groove, respectively, and having an inboard side thereof seated in said first vertical groove of said first vertical strut and an outboard side thereof being an outer surface of said truss;

said lower chord having a portion of a bottom surface thereof beneath said first strut and said first solid web member for a first load bearing surface for the truss; and means including said upper chord, said lower chord and said first web member forming a first weight bearing I-beam section at said first end of said truss (1) for supporting said truss on the first load bearing surface, and (2) for being trimmable up to a distance as defined by the length of said first web member when necessary to change the length of said truss.

2. The truss of claim 1 further comprising:

said upper chord having a third longitudinal groove in a bottom surface at said second end of said truss;

said lower chord having a fourth longitudinal groove in a top surface thereof beneath said third groove;

said second vertical strut at said second end of said truss being inboard of said third groove and said fourth groove; said second strut having a second vertical groove in an outboard side thereof;

a second solid web member having a top and bottom thereof seated in said third groove and said fourth groove, respectively, and having an inboard side thereof seated in said second vertical groove and an outboard side thereof being another outer surface of said truss;

said lower chord having a portion of the bottom surface thereof beneath said second strut and said second solid web member for a second load bearing surface for said truss; and means including said upper chord, said lower chord and said second web member forming a second weight bearing I-beam section at said second end of said truss (1) for supporting said truss on the second load bearing surface, and (2) for being trimmable up to a distance as defined by the length of said second web member when necessary to change the length of said truss.

3. The truss of claim 1 wherein said first web member and said second web member was glued in the respective grooves of said upper chord, said lower chord, said first strut and said second strut.

4. The truss of claim 1 wherein said first solid web member is one to two feet long.

5. The truss of claim 2 wherein said first solid web member and said second solid web member are each one foot long.

6. A plurality of the trusses of claim 5 in different spans beginning at 4 feet and increasing at 2 foot increments to a at least a span of 24 feet wherein the plurality of trusses provides a source of a truss of any length from 2 feet to 24 feet by appropriate trimming of a truss when the length needed is not 4 feet or a 2 foot increasing increment thereof.

7. A method of employing the variable length truss according to claim 1 comprising the steps of:

(a) making a plurality of the trusses in different lengths;

(b) stocking the trusses made in step (a) whereby the trusses are made to inventory rather than to a specification for the structure;

(c) removing the trusses stocked in step (b) as needed for use as a ceiling, a roof or a floor joist during construction; and (d) trimming said I-beam section of the removed trusses as required during construction.

8. The method of claim 7 wherein in step (a) the trusses are formed in increasing increments of two feet, and said I-beam section is formed in a two foot length.

9. A method of employing the variable length truss of claim 2 comprising the steps of:

(a) making a plurality of the trusses in different lengths beginning at a first length and increasing in length by increments of a predetermined distance equal to the sum of the lengths of said first and second web members to a longest truss, wherein the plurality of trusses provides a source of a truss of any length from said first length trimmed by said predetermined distance to the length of the longest truss by appropriate trimming of a suitable one of the trusses when the length needed is not said first length or other lengths corresponding to increasing increments of said predetermined distance;

(b) stocking the trusses made in step (a) wherein the trusses are made to inventory rather than to a specification for the structure;

(c) removing the trusses stocked in step (b) as needed for use during construction of the structure; and (d) trimming the I-beam sections of the removed trusses as required during construction.

10. The method of claim 9 wherein in step (a) the trusses are formed in increasing increments of two feet, and said first and second I-beam sections are formed in a one foot lengths.

11. The truss of claim 1 wherein the chords, struts, web members and open web structure are made of wood.

12. The truss of claim 11 further comprising a plurality of fasteners for binding the struts and the members of said open web section to said upper chord and said lower chord.

13. The truss of claim 12 wherein the fasteners are formed from sheet metal and have sharp points or have nails therethrough for binding the struts and cross members to said upper chord and said lower chord.

14. The truss of claim 12 wherein a plurality of the members of said open web section are cross members connected together end-to-end alternately at said upper chord and at said lower chord by the fasteners.

15. A plurality of the trusses of claim 5 in different spans beginning at 4 feet and increasing at 2 foot increments to at least a span of 20 feet wherein the plurality of trusses provides a source of a truss of any length from 2 feet to 20 feet by appropriate trimming of a truss when the length needed is not 4 feet or a 2 foot increasing increment thereof.

16. A structural component for use as a ceiling, a roof or a floor joist in a structure comprising:

(a) a top chord member;

(b) a bottom chord member;

(c) an open web means connecting the top chord member and bottom chord member;

(d) at least one load bearing solid web located below the top chord member and wherein the top chord member comprises at least one weight bearing end of the top chord member defined as that portion of the top chord member located above the at least one solid web and wherein the bottom chord member defines at least one weight bearing end defined as that portion of the bottom chord member located below the at least one solid web and wherein the solid web occupies the space between the at least one weight bearing end of the top chord and the at least one weight bearing end of the bottom chord member; and wherein a strut for maintaining separation distance and strength is mounted to the at least one solid web located between the at least one weight bearing end of the top chord and the at least one weight bearing end of the bottom chord; and wherein the component further comprises a securing means for mounting the strut to an inboard side of the at least one solid web, an outboard side of the at least one solid web being an outer surface of the component; and wherein the securing means further comprises a grooved opening in the strut and wherein the at least one solid web further defines a side plug and wherein the side plug is inserted within the grooved opening; said top chord member, said bottom chord member and said solid web defining a weight bearing I-beam structure at an end of said component; and said I-beam structure being trimmable the length of said solid web to change the length of said component.

17. The component of claim 16, wherein the securing means further comprises glue.

18. The component of claim 17, wherein the securing means further comprises at least one securing pin passing through the at least one solid web and the strut.

19. The component of claim 16, wherein the at least one solid web and top chord are connected by a joining means.

20. The component of claim 19, wherein the solid web further comprises a top plug and wherein the top chord further comprises a top groove and wherein the joining means further comprises the top plug being fitted within the top groove.

21. The component of claim 20, wherein the at least one solid web defines a bottom plug and wherein the bottom chord further defines a bottom groove located substantially below the top groove receiving the bottom plug.

22. The component of claim 19, wherein the top plug defines a semi-circular shape and wherein the top groove defines a semi-circular shape.

23. The component of claim 21, wherein the bottom plug defines a semi-circular shape and wherein the top groove defines a semi-circular shape.

24. The component of claim 19, wherein the joining means further comprises a glue line between the points of intersection of the top chord member and the at least one solid web.

25. The component of claim 16, wherein the at least one load bearing end of the top chord member defines a termination point substantially above the at least one solid web and wherein the at least one solid web is secured on at least three sides by a top securing means between the at least one solid web and the top chord member, a bottom securing means between the at least one solid web and the bottom chord member, and a side securing means located between the strut and the at least one solid web, and wherein the strut further imparts structural support so as to impart sufficient crush strength to the at least one solid web so as to render it structurally sound between the side securing means and the load bearing end of the top chord member.

26. The component of claim 25, wherein the top, bottom and side securing means comprises glue, and wherein the strut provides structural integrity to the at least one solid web.

27. A structural component for use as a ceiling, a roof or a floor joist comprising:

(a) a top chord member;

(b) a bottom chord member;

(c) an open web means for connecting the top chord member and bottom chord member;

(d) at least one load bearing solid web located below the top chord member and wherein the top chord member comprises at least one weight bearing end of the top chord member defined as that portion of the top chord member located above the at least one load bearing solid web and wherein the bottom chord member defines at least one weight bearing end defined as that portion of the bottom chord member located below the at least one solid web, and wherein the open web means defines an opening for the passage of conduit and pipe; and wherein the at least one top chord member weight bearing end defines a termination point substantially above the solid web and wherein the at least one solid web is secured on at least three sides by a top securing means between the at least one solid web and the top chord member, a bottom securing means between the at least one solid web and the bottom chord member and a side securing means located interior of the load bearing end and wherein the side securing means further imparts structural support so as to impart sufficient crush strength to the at least one solid webbing so as to render the at least one solid web structurally sound between the side securing means and the termination point of the load bearing end of the top chord member and wherein the side securing means further comprises a web stiffener fixed to an inboard side of the at least one solid web to impart structural integrity to the at least one solid web, an outboard side of the at least one solid web being an outer surface of the component; and wherein the web stiffener is further defined as defining a slot defining a back, a left end and a right end and the solid web is further defined as defining a side plug and wherein the side plug fits within the web stiffener slot so as to support the perpendicular movement of the at least one solid web between the left and right ends of the slot; said top chord member, said bottom chord member and the at least one solid web defining a weight bearing I-beam structure at the load bearing end of said component; and said I-beam structure being trimmable up to a distance as defined by the length of the at least one solid web to change the length of said component.

28. The component of claim 27, wherein the web stiffener is further defined by a glue line connecting the side plug to at least one side of the left, right and back side of the slot.

29. The component of claim 28, wherein the web stiffener is further defined by at least one securing pin passing through the at least one solid web and web stiffener to reduce lateral movement and maintain contact between the web stiffener and the at least one solid web during the drying period of the glue line.

30. The component of claim 29, wherein the web stiffener is further defined by at least two pins securing the web stiffener to the at least one solid web so as to prevent the lateral movement of the at least one solid web.

31. A variable length truss for use as a ceiling, a roof or a floor joist comprising:

a 4"×2" wooden upper chord having a first longitudinal groove in a bottom surface at a first end of said truss;

a 4"×2" wooden lower chord spaced from and parallel to said upper chord, said lower chord having a second longitudinal groove in a top surface thereof beneath said first groove;

a first 4"×2" wooden vertical strut at said first end of said truss between said upper chord and said lower chord and inboard of said first groove and said second groove; said first strut having a vertical groove in an outboard side thereof;

a second 4"×2" wooden vertical strut at a second end of said truss between said upper chord and said lower chord;

an open web structure including a plurality of 4"×2" wooden cross members, said open web structure being inboard of said first strut and said second strut and between said upper chord and said lower chord, a first wooden web member seated in said first groove and said second groove and having an inboard side seated in said vertical groove of said first vertical strut, and an outboard side being an outer surface of said truss;

said lower chord having a portion of a bottom surface thereof beneath said first strut and said first web member for a load bearing surface for said truss; and means including said upper chord, said lower chord and said first web member forming a first weight bearing I-beam section at said first end of said truss (1) for supporting said truss on the first load bearing surface, and (2) for being trimmable up to a distance as defined by the length of said first web member when necessary to change the length of said truss.

32. The truss of claim 31 further comprising:

said upper chord having a third longitudinal groove in a bottom surface at said second end of said truss;

said lower chord having a fourth longitudinal groove in a top surface thereof beneath said third groove;

said second vertical strut being inboard of said third groove and said fourth groove, and having a second vertical groove in an outboard side thereof;

a second wooden web member seated in said third groove and said fourth groove and having an inboard side thereof seated in said second vertical groove and an outboard side being another outer surface of said truss;

said first web member and said second web member each being formed of solid oriented strand board and each being one foot in length;

said lower chord having a portion of the bottom surface thereof beneath said second strut and said second web member for a second load bearing surface for said truss;

at least one additional vertical wooden strut between said upper chord and said lower chord and said first vertical strut and said second vertical strut;

a plurality of fasteners for binding the struts and the cross members to said upper chord and said lower chord; and means including said upper chord, said lower chord and said second web member forming a second weight bearing I-beam section at said second end of said truss (1) for supporting said truss on the second load bearing surface, and (2) for being trimmable up to a distance as defined by the length of said second web member to change the length of said truss.

33. A family of variable length trusses for installation in a structure as ceiling, roof or floor joists, each one of the trusses comprising:

an upper chord;

a lower chord spaced from said upper chord;

a first solid web member fixed to a bottom of said upper chord and to a top of said lower chord at a first end of said truss;

a first vertical strut between said upper chord and said lower chord at said first end of said truss an d fixed to an inboard side of said first solid web member, said first strut having a transverse thickness greater than that of said first solid web member, whereby said first vertical strut and said first solid web member have a T-shaped horizontal cross-section extending to the outer edge of said truss;

an open web section inboard of said first strut and including a plurality of members interconnecting said upper chord and said lower chord;

said lower chord having a first portion of a bottom surface thereof beneath said first strut and said first solid web member for a first load bearing surface of said truss; and means including said upper chord, said lower chord, said first strut and said first web member forming a first weight bearing I-beam section at said first end of said truss (1) for supporting said truss on the first load bearing surface, and (2) for being trimmable up to a predetermined distance as defined by at least the length of said first solid web member when necessary to change the length of said truss;

said family of trusses being in different spans beginning with a shortest truss having a first span and increasing in length by increments of said predetermined distance to a longest truss having a longest span, and said family of trusses providing a source of a truss of any span from said first span trimmed by said predetermined distance to said longest span of said longest truss by appropriate trimming of said first solid web member on a respective one of said family of trusses when the length needed is not said first span or other spans corresponding to increasing increments of said predetermined distance; and said family of trusses being made to an inventory rather than to specifications for a structure.

34. The family of trusses of claim 33 wherein each one of the trusses further comprises:

a second solid web member fixed to the bottom of said upper chord and to the top of said lower chord at a second end of said truss;

a second vertical strut between said upper chord and said lower chord at said second end of said truss and fixed to an inboard side of said second solid web member, said second strut having a transverse thickness greater than that of said second solid web member, whereby said second vertical strut and said second solid web member have a T-shaped horizontal cross-section extending to the outer edge of said truss;

said lower chord having a second portion of the bottom surface thereof beneath said second strut and said second solid web member for a second load bearing surface of said truss; and means at said second end of said truss including said upper chord, said lower chord, said second strut and said second web member forming a second weight bearing I-beam section (1) for supporting said truss on the second load bearing surface, and (2) for being trimmable up to the length of said second solid web member when necessary to change the length of said truss; said predetermined distance being equal to the sum of the lengths of said first solid web member and said second solid web member.

35. The trusses of claim 34 wherein said upper chord and said lower chord are parallel.

36. The trusses of claim 33 wherein said first web member is two feet long.

37. The trusses of claim 33 wherein said first web member is one foot long.

38. The trusses of claim 34 wherein said first web member and said second web member are each one foot long.

39. The trusses of claim 34 further comprising a plurality of fasteners for binding the plurality of members of said open web section to said upper chord and said lower chord.

40. A family of variable length trusses for installation in a structure as ceiling, roof or floor joists, each one of the trusses comprising:

an upper chord;

a lower chord spaced from said upper chord;

a first solid web member fixed to a bottom of said upper chord and to a top of said lower chord at a first end of said truss;

a first vertical strut between said upper chord and said lower chord at said first end of said truss and fixed to an inboard side of said first solid web member, said first strut having a transverse thickness greater than that of said first solid web member, whereby said first vertical strut and said first solid web member have a T-shaped horizontal cross-section extending to the outer edge of said truss;

an open web section inboard of said first strut and including a plurality of members interconnecting said upper chord and said lower chord;

said lower chord having a first portion of a bottom surface thereof beneath said first strut and said first solid web member for a first load bearing surface of said truss; and means including said upper chord, said lower chord, said first strut and said first web member forming a first weight bearing I-beam section at said first end of said truss (1) for supporting said truss on the first load bearing surface, and (2) for being trimmable up to the length of said first solid web member when necessary to change the length of said truss;

a second solid web member fixed to the bottom of said upper chord and to the top of said lower chord at a second end of said truss;

a second vertical strut between said upper chord and said lower chord at said second end of said truss and fixed to an inboard side of said second solid web member, said second strut having a transverse thickness greater than that of said second solid web member, whereby said second vertical strut and said second solid web member have a T-shaped horizontal cross-section extending to the outer edge of said truss;

said lower chord having a second portion of the bottom surface thereof beneath said second strut and said second solid web member for a second load bearing surface of said truss; and means at said second end of said truss including said upper chord, said lower chord, said second strut and said second web member forming a second weight bearing I-beam section (1) for supporting said truss on the second load bearing surface, and (2) for being trimmable up to the length of said second solid web member when necessary during installation to change the length of said truss;

the sum of the lengths of said first solid web member and said second solid web member defining a predetermined distance;

said family of trusses being in different spans beginning with a shortest truss having a first span and increasing in length by increments of said predetermined distance to a longest truss having a longest span, and said family of trusses providing a source of a truss of any span from said first span trimmed by said predetermined distance to said longest span of said longest truss by appropriate trimming of said first and/or second solid web members on a respective one of said family of trusses when the length needed is not said first span or other spans corresponding to increasing increments of said predetermined distance; and said family of trusses being made to an inventory rather than to specifications for a structure.

41. A variable length truss for use in a structure as a ceiling, a roof or a floor joist comprising:

an upper chord;

a lower chord spaced from said upper chord;

a first solid web member fixed to a bottom of said upper chord and to a top of said lower chord at a first end of said truss;

a first vertical strut between said upper chord and said lower chord at said first end of said truss and fixed to an inboard side of said first solid web member, said first strut having a transverse thickness greater than that of said first solid web member, whereby said first vertical strut and said first solid web member have a T-shaped horizontal cross-section extending to the outer edge of said truss;

an open web section inboard of said first strut and including a plurality of members interconnecting said upper chord and said lower chord;

said lower chord having a first portion of a bottom surface thereof beneath said first strut and said first solid web member for a first load bearing surface of said truss;

means including said upper chord, said lower chord, said first strut and said first web member forming a first weight bearing I-beam section at said first end of said truss (1) for supporting said truss on the first load bearing surface, and (2) for being trimmable up to the length of said first solid web member when necessary to change the length of said truss;

a second solid web member fixed to the bottom of said upper chord and to the top of said lower chord at a second end of said truss;

a second vertical strut between said upper chord and said lower chord at said second end of said truss and fixed to an inboard side of said second solid web member, said second strut having a transverse thickness greater than that of said second solid web member, whereby said second vertical strut and said second solid web member have a T-shaped horizontal cross-section extending to the outer edge of said truss;

said lower chord having a second portion of the bottom surface thereof beneath said second strut and said second solid web member for a second load bearing surface of said truss; and means at said second end of said truss including said upper chord, said lower chord, said second strut and said second web member forming a second weight bearing I-beam section (1) for supporting said truss on the second load bearing surface, and (2) for being trimmable up to the length of said second solid web member when necessary to change the length of said truss.

* * * * *